US005625347A

United States Patent [19]

MacLean et al.

[11] Patent Number: 5,625,347

[45] Date of Patent: Apr. 29, 1997

[54] ELECTRONIC BOTTLE CAP

[75] Inventors: Chris J. MacLean, Toronto; Richard Dupuis, Pickering, both of Canada

[73] Assignee: Molson Breweries, Toronto, Canada

[21] Appl. No.: 236,332

[22] Filed: May 2, 1994

[30] Foreign Application Priority Data

Sep. 20, 1993 [CA] Canada ..... 2106528

[51] Int. Cl.[6] ..... G08B 21/00

[52] U.S. Cl. ..... 340/686; 340/571; 340/540; 340/691; 340/692; 340/693; 340/384.1; 340/384.3; 206/459.1; 206/539; 206/807

[58] Field of Search ..... 340/686, 571, 340/540, 691, 692, 693, 384.1, 384.3; 206/459, 539, 807, 459.1

[56] References Cited

U.S. PATENT DOCUMENTS

| | | | |
|---|---|---|---|
| 4,157,143 | 6/1979 | Doi | 215/228 |
| 4,253,580 | 3/1981 | Doi et al. | 215/228 |
| 4,310,100 | 1/1982 | Kunimoto et al. | 215/228 |
| 4,372,457 | 2/1983 | Kunimoto et al. | 215/228 |
| 4,505,132 | 3/1985 | Howes et al. | 62/457 |
| 4,801,929 | 1/1989 | Instance | 340/692 |
| 4,847,597 | 7/1989 | Dobosi et al. | 340/571 |
| 4,911,320 | 3/1990 | Howes | 220/20 |
| 5,056,659 | 10/1991 | Howes et al. | 206/217 |
| 5,056,681 | 10/1991 | Howes | 220/522 |
| 5,076,433 | 12/1991 | Howes | 206/459 |
| 5,099,232 | 3/1992 | Howes | 340/815.21 |
| 5,313,439 | 5/1994 | Albeck | 206/539 |

FOREIGN PATENT DOCUMENTS 1318026 5/1993 Canada .

*Primary Examiner*—Jeffery Hofsass
*Assistant Examiner*—Benjamin C. Lee
*Attorney, Agent, or Firm*—Anthony J. Casella; Gerald E. Hespos

[57] ABSTRACT

A device for delivering an audible message is described. It includes a housing adapted for releasable emplacement on an externally threaded bottle neck. The housing includes a substantially disc-shaped main body, and a downwardly depending skirt around the perimeter thereof. Circuit means are located within the housing and include means for securing thereto a source of electrical energy, and programmable means for encoding an audible message on the circuit means. A speaker is provided within the housing, electrically connected to the circuit means for delivering the audible message. Switch means are associated with the circuit means adapted to maintain the circuit in an open state whilst said housing is in releasable emplacement on a bottle, and to close the circuit upon removal of the housing from the bottle. Removable of the housing from the bottle causes the audible message to be delivered via the speaker.

5 Claims, 3 Drawing Sheets

ELECTRONIC BOTTLE CAP

The present invention relates to the field of devices for the promotion of consumer products. In particular, the present invention provides a novel bottle cap, for instance a crown-type bottle cap, for capping beverage bottles, the cap being equipped with an electronic device to deliver an audible message to the consumer upon the opening of the bottle, to signal that a prize has been won by the consumer.

In order to promote the sale of consumer products, such as canned or bottled beverages, manufactures and bottlers often run promotional contests. In a common form of such a contest, selected beverage containers, either cans or bottles are marked to indicate to the consumer, after the product container has been opened, that a prize has been won by the consumer. For instance, the pull tab of a can may be inscribed with a prize related message that is visible only after the can has been opened. Alternatively, the liner of a crown type bottle cap may be marked with a prize related message on its underside, so that after the bottle has been opened, the liner may be peeled back to indicate if a prize has been won. These two common methods of indicating if a prize has been won rely heavily, however, on educating the consumer by way of media advertising to tell the consumer that a contest is under way, and to tell them what they should do to participate in the contest. It is, of course, feasible to imprint the containers of such products with appropriate contest related graphics and instructions, but that approach will not assure the bottler that every consumer of the product in question will read the instructions or participate in the contest.

One form of device that has been proposed to overcome the above-noted drawbacks associated with simply imprinting prize related messages on bottle or can components or caps is described in U.S. Pat. No. 5,056,659, "PRIZE HOLDING CONTAINER ASSEMBLIES" issued Oct. 15, 1991 to James P. Howes et al. In that U.S. patent, a can simulating a genuine beverage container, but including a prize delivery system is shown, the prize delivery system comprising a cylinder that pops up from the can when it is opened. The cylinder may contain a prize certificate or a currency note. Also disclosed are other simulated can structures including compartments for holding such prizes, and bottle caps of the enlarged screw on plastic sort that may have prize holding compartments hidden therein. It will be observed, though, that such a prize holding compartment in a large bottle cap is simply an enlargement of the known method of indicating that a prize has been won by marking the underside of the cap liner.

In another U.S. Pat. No. 5,099,232 to James P. Howes, dated Mar. 24, 1992 and entitled "PRIZE HOLDING CONTAINER ASSEMBLIES", a simulated product holding can is disclosed including electronic means to inform the consumer by way of an audible message that a prize has been won. Such an assembly is activated by a switch aligned with the pull tab which, when the pull tab is lifted, is depressed and closes a circuit including batteries, a micro chip and a speaker to deliver a prize related message. Such a system is clearly desirable from a marketing perspective, since it informs the consumer immediately that a prize has been won, regardless of whether the consumer has previous knowledge of the contest, and regardless of whether the consumer has read any prize related text on the can. It suffers from several drawbacks though. In order to provide the weight and feel of a normal beverage container, a feature that is necessary to ensure that "winners" cannot be predetermined by consumers, the can is appropriately weighted, and the side walls thereof reinforced. However, it has been observed that such efforts have been unable to duplicate the resilient feel of a pressurized can, such as a can containing beer. Moreover, the characteristic sound and weight shift of beer (or another beverage) in a can will also necessarily be absent. Therefore, this form of simulated container prize assembly is appropriate for use in multi-packs (such as 12 or 24 can packs of beer) wherein all the individual cans are contained within a sealed cardboard carton. This type of simulated can is unsuitable for use in ring-packs where six cans of beer are sold together, connected by their upper extremities by a die cut series of six plastic rings in a two by three arrangement. In such a ring-pack, the cans are open to inspection by a consumer prior to purchase, and 'winners' may be ferreted out by curious consumers.

Moreover, the system proposed in U.S. Pat. No. 5,099,232 is wholly unsuitable for use with bottles. It occupies a large part of the volume of the container in question, and would, of course, be visible through the bottle, even if the bottle were tinted. Moreover, Howes, does not disclosure any appropriate switch mechanism for use with a bottle.

The object of the present invention is to overcome disadvantages associated with the prior art, and provide a bottle cap having an electronic message delivery system wholly contained therein that can be used to deliver a prize related message to a consumer upon the opening of a beverage bottle. Moreover, the bottle cap of the present invention is inexpensive to manufacture, and virtually impossible to detect by visual or tactile inspection of the product prior to opening.

In a broad aspect, then the present invention relates to a device for delivering an audible message including: (i) a housing adapted for releasable emplacement on an externally threaded bottle neck, said housing including a substantially disc-shaped main body, and a downwardly depending skirt around the perimeter thereof; (ii) circuit means within said housing including means for securing thereto a source of electrical energy, and programmable means for encoding an audible message on said circuit means; (iii) a speaker within said housing, electrically connected to said circuit means for delivering said audible message; (iv) switch means associated with said circuit means, said switch means being adapted to maintain said circuit in an open state whilst said housing is in said releasable emplacement on a said bottle, and to close said circuit upon removal of said housing from said bottle; whereby removal of said housing from said bottle causes said audible message to be delivered via said speaker.

In drawings which illustrate the present invention by way of example:

Figure 1:
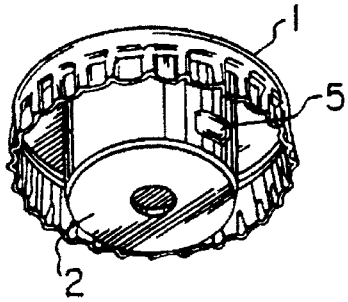
FIG. 1 is a perspective view of an electronic bottle cap according to the present invention, shown from the underside thereof.

Referring now to the drawings, a crown-type bottle cap 1 of the crimp-on, twist-off variety forms an external housing for the device of the present invention which is substantially fully within the depth of the cap 1 when it is in a crimped state. The electronic position of the device of the present invention is enclosed within a short cylindrical internal housing 2. Housing 2 is provided with a lid 3 in the shape of a disc that is adhesively affixed to the centre of the underside of crown cap 1. The housing 2 may then be press-fit or adhesively secured to lid 3, to be held securely to the underside of crown cap 1.

Figure 2:
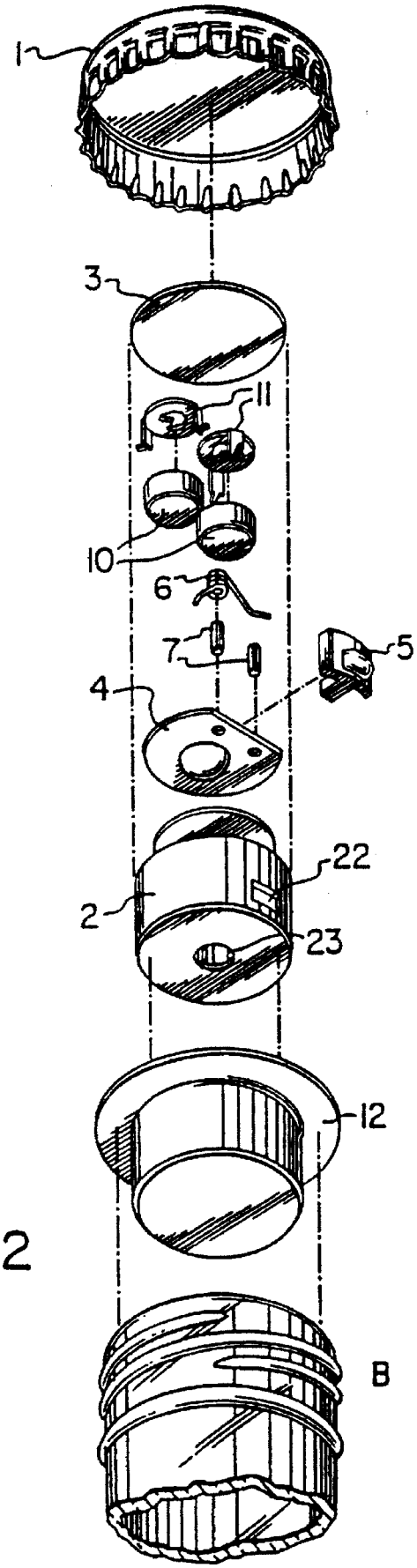
FIG. 2 is an exploded view of the device of FIG. 1, in association with an appropriate liner according to the present invention; and a bottle.

Referring to FIG. 2, the exploded view, it will be observed that within housing 2 are located axially, from bottom to top, speaker 9, that in a preferred embodiment is a piezo ceramic resonator, available for instance, from Murato Erie under the designation 7-BB-15-5 (or equivalent), a circuit board 4 or water, on the underside of which is mounted a microchip 8 encoded with firmware to deliver an audible message on activation; and on the upper surface of board 4, a pair of silver dioxide button cell batteries 10, cell type 164 364, held in place by a pair of battery clip terminals 11, as well as contact posts 7, and spring switch 6.

The contact posts 7 extend through apertures 41 in circuit board 4, whereby they are held in an upright position, spaced apart and adjacent to the battery clips 11, the legs 112 of which extend through board 4 to maintain the batteries 10 in position on board 4.

One post 7 is connected by a short electrical lead to a thin metal contact on the surface of board 4, below one of the batteries 10, in contact with the negative surface contact thereof. The other post is connected by a short electrical lead to the positive surface of the other battery 10 via the battery clip 11 thereof, each said clip 11 including a downwardly depending spring biased contact 111 electrically engaging the upwardly facing positive contact surface of the battery 10.

The positive surface contact of the first mentioned battery is, as noted, in contact with the contact 111 of the clip thereof, and the clip, via one of the legs 112 thereof that extend through the board 4, is electrically linked to the circuit on the circuit board 4. The other of said batteries 10 which as mentioned has its positive contact surface in electrical engagement with one of the posts, via the clip 11 holding the battery 10 in place, and has its negative surface in contact with a metallic electrode (not illustrated) formed in the upper surface of the circuit board 4. That electrode extends through the circuit board, and is in electrical contact with the circuit on board 4.

A spring switch element 6 extends between posts 7. Spring 6 is illustrated in detail in FIG. 6, and includes a coiled portion dimensioned to fit snugly over one of the contact posts 7, and an outwardly extending element that is bent at its end to engage the other post. A short tensioning element also extends from spring 6, and it may be biased against battery 10 adjacent the post that has the coiled end of the spring fit around it. Accordingly, it will be understood that the post 7 that will accept the coiled element of the spring 6 will be in electrical engagement with the positive of its adjacent battery 10 via the clip 11 thereof to permit the tensioning end of the spring to also contact the positive surface of the battery 10 or its clip 11.

Radially adjacent the gap between posts 7, where the spring 6 extends between the posts 7, a small aperture 22 is formed in housing 2, to accommodate an actuator 5 that includes a button portion 51 that projects outwardly from the housing, and a portion internal of the housing that is provided with a recess 52 to engage spring 6 between posts 7. An arcuate portion 53 on actuator 5 maintains actuator 5 inside housing 2, with the button portion 51 of the actuator extending therefrom. Depression of button 51 inwardly will cause the spring 6 to move away from the post against which it is urged, to open the circuit of the device. Release of the button will, accordingly, close the circuit, and cause the chip 8 to deliver an audible message via speaker 9. It a preferred embodiment, the firmware encoded in chip 8 will cause the audible message to be delivered a predetermined number of times, after which the device will turn itself off, until the circuit is opened and closed again.

Figure 3:
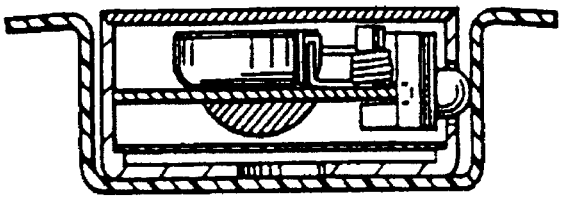
FIG. 3 is a cross-sectional view, through the switch actuator of the device of FIG. 1, and an appropriate liner, with the switch in an open position.
Figure 4:
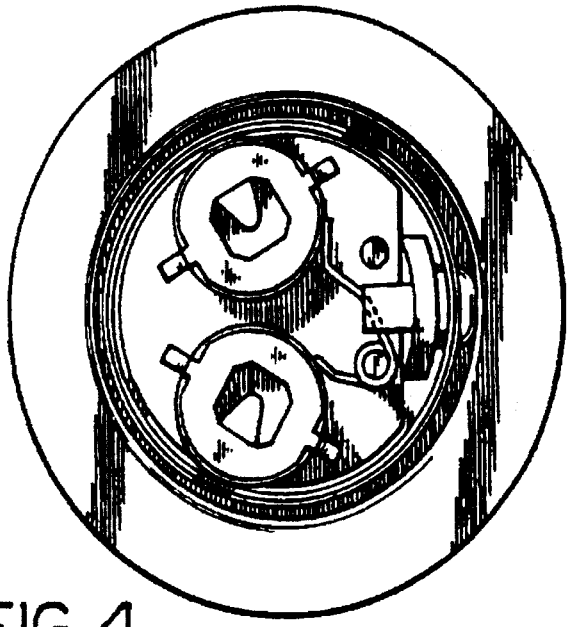
FIG. 4 is a plan view of the interior of the device of FIG. 1, removed from its bottle-cap housing, with the switch in the open position, and the device shown with an appropriate liner.

With reference to FIGS. 2 and 3, it will be observed that in the lowermost portion of the interior of housing 2, a ledge 21 is formed around the interior perimeter, and a small round aperture 23 is formed in the lowermost surface of the housing 2. The ledge serves as a mounting surface for speaker 9, there being a small space beneath the speaker to permit same to resonate and produce acceptable quality audible tones. Sound aperture 23 permits the audible tones produced by speaker 9 to be heard more clearly, as it creates an airway through which sound waves may pass without substantial distortion.

Figure 5:
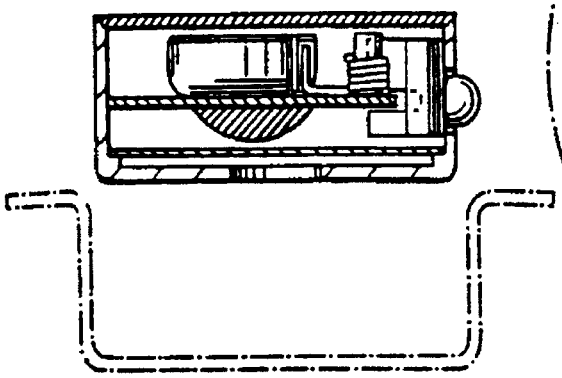
FIGS. 5 and 6 are the same views as FIGS. 3 and 4, with the switch in a closed position.
Figure 6:
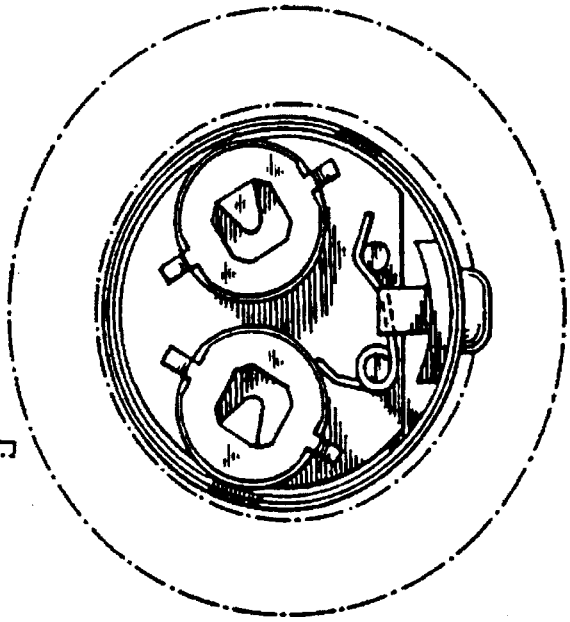
Figure 7:
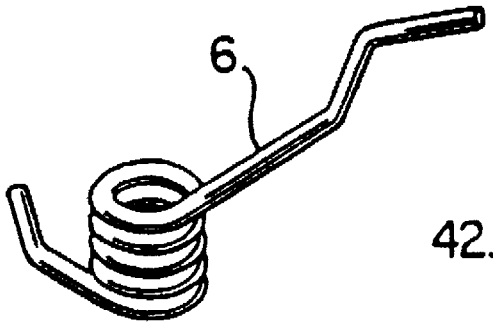
FIG. 7 is a perspective view of the spring switch used in the device of the present invention.
Figure 8:
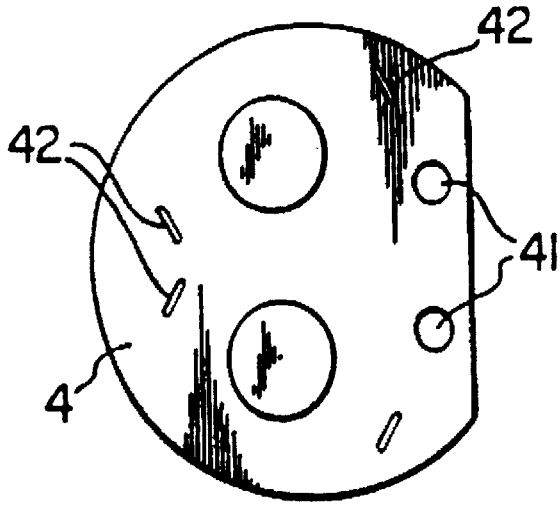
FIG. 8 is a plan view of the circuit board wafer of the device of the present invention.
Figure 9:
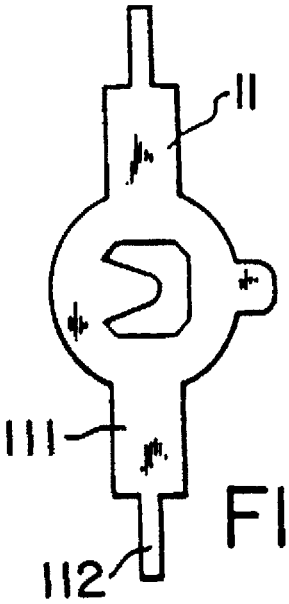
FIG. 9 is a plan view of a blank for a battery clip for the device of the present invention.
Figure 10:
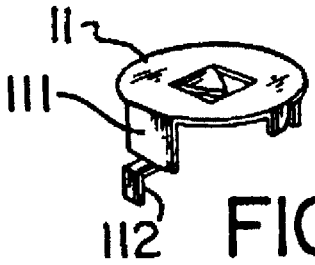
FIG. 10 is a perspective view of the blank of FIG. 9, correctly folded to form a battery clip.
Figure 11:
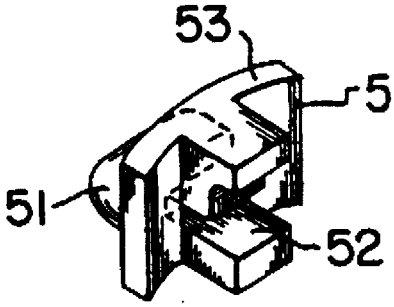
FIG. 11 is a perspective view of the switch actuator of the device of the present invention.

As can be seen from FIG. 2–6, the electronic device of the present invention is used in conjunction with a liner 12 of an inverted top-hat shape, that is dimensioned to fit inside the tubulure of a bottle B, at the upper extremity thereof. Liner 12 is of a thickness selected so that when housing 2 is inserted therein in a capping procedure (after which twist-off crown cap will be crimped) actuator button 51 is pressed inwardly to push spring 6 away from one of the contact posts 7, thereby opening the electrical circuit of the device (see FIGS. 3 and 4). Removal of the cap, as shown in FIGS. 5 and 6, releases spring 6, and closes the circuit, causing chip 8 to be energised and the audible message to be delivered. The message can be repeated by a winning participant by subsequent depression and release of button 51.

Liner 12 should be made of a foodstuff-compatible FDA approved plastics material, such as DuPont SURLYN™ teflon, or nylon, and preferably, is adhesively secured to the uppermost rim of the tubulure of bottle B. The liner should be of a colour selected to camouflage the presence of housing 2 in bottle cap 1, so that a consumer would be unable to predetermine a winning bottle. Through the use of a foodstuff compatible plastic material, it is feasible to fill bottle B with the product being promoted, without danger of contamination of the product by contact with any of the electronic parts in housing 2. However, it may be preferable, as a practical matter, to fill the bottle with coloured soda water or the like, because it will have its cap applied by hand away from a usual bottling line. Winning bottles may then be seeded into production lines downstream of the usual capping station.

It may also be desired to apply a decorative neck foil over the cap, to further hide the underside of the cap from view, and also to serve as a tampering evident seal which would be broken by anyone removing the cap prior to purchase.

It will also be understood that the device of the present invention may incorporate an LED read-out or other lighting means, for additional promotional effect, without departing from the spirit of the present invention.

It is to be understood that the examples described above are not meant to limit the scope of the present invention. It is expected that numerous variants will be obvious to the person skilled in the field of engineering and associated technology without any departure from the spirit of the invention. The appended claims, properly construed, form the only limitation upon the scope of the invention.

The embodiments of the invention in which an exclusive property or privilege is claimed are defined as follows:

1. A device for delivering an audible message, comprising:

a crown-type twist-off bottle cap for releasable emplacement on an externally threaded bottle neck, said bottle cap including a substantially disc-shaped main body having a perimeter, a downwardly depending skirt around the perimeter of said main body;, a cylindrical body extending beneath said main body and being provided with a radially disposed aperture;

a circuit in said cylindrical body, said circuit including means for securing thereto a source of electrical energy, and programmable means for encoding an audible message on said circuit;

a speaker in said cylindrical body, electrically connected to said circuit for delivering said audible message; and a switch associated with said circuit, such that a portion of said switch extends through said radially disposed aperture of said cylindrical body, said switch including radially outwardly biasing spring means for maintaining said circuit in a closed state, emplacement of said bottle cap on said bottle causing said switch means to be urged inwardly to open said circuit and removal thereof causing said switch means to close said circuit, whereby removal of said bottle cap from said bottle causes said audible message to be delivered.

2. A device as claimed in claim 1, wherein said cylindrical body extends no further than said downwardly depending skirt on said bottle cap.

3. A device as claimed in claim 1, in combination with a liner for emplacement between the neck of the bottle and said bottle cap, said liner having an inverted top-hat shape to accommodate said cylindrical body.

4. An assembly for delivering an audible message, said assembly comprising:

a device for delivering an audible message including:

a housing adapted for releasable emplacement on an externally threaded bottle neck, said housing including a substantially disc-shaped main body having a radially disposed aperture, and a downwardly depending skirt around the perimeter thereof;

circuit means within said housing including means for securing thereto a source of electrical energy, and programmable means for encoding an audible message on said circuit means;

a speaker within said housing, electrically connected to said circuit means for delivering said audible message; and switch means associated with said circuit means and extending through said radially disposed aperture of said disc-shaped main body, said switch means engaging an inner surface of said bottle neck such that said switch means maintains said circuit in an open state whilst said housing is in said releasable emplacement on said bottle neck, and to close said circuit upon removal of said housing from said bottle neck; whereby removal of said housing from said bottle neck causes said audible message to be delivered via said speaker.

5. A device as claimed in claim 4, in combination with a liner form placement between the neck of the bottle and said housing, said liner having an inverted top-hat shape to accommodate said cylindrical body.

* * * * *